United States Patent [19]

Whitty

[11] 4,256,078

[45] Mar. 17, 1981

[54] BRICK FINISHING MACHINE

[75] Inventor: Parnell Whitty, Union Hill, N.Y.

[73] Assignee: The R. T. French Co., Rochester, N.Y.

[21] Appl. No.: 93,890

[22] Filed: Nov. 13, 1979

[51] Int. Cl.[3] ..... B28D 1/18

[52] U.S. Cl. ..... 125/3; 51/5 B; 125/26

[58] Field of Search ..... 125/2, 3, 26; 51/5 B

[56] References Cited

U.S. PATENT DOCUMENTS

| | | | |
|---|---|---|---|
| 1,945,490 | 1/1934 | Oldham | 125/3 |
| 2,958,163 | 11/1960 | Cammerzell | 125/26 X |
| 3,292,310 | 12/1966 | Lefevre | 125/26 |
| 3,918,210 | 11/1975 | Mori | 125/3 |

FOREIGN PATENT DOCUMENTS

| | | | |
|---|---|---|---|
| 981085 | 1/1965 | United Kingdom | 125/3 |

*Primary Examiner*—Harold D. Whitehead
*Attorney, Agent, or Firm*—Shlesinger, Fitzsimmons & Shlesinger

[57] ABSTRACT

Unfinished bricks are placed lengthwise on the inlet end of a first horizontal frame section, and are pushed one after another toward a discharge station at the opposite end of the section by a plurality of spaced flight bars, which are carried by an endless chain that travels beneath an elongate slot in the center of the first frame section. Four separate grinding operations are performed on each brick as it travels toward the discharge station. At the first station opposite sides of the brick are ground to provide the desired brick width; at the second station two parallel slots are ground in its bottom surface; at the third station a radius groove is cut in one side of each of the two bottom slots; and at the fourth station the top of the brick is ground or rounded off at each end. At the discharge station each brick is pushed at right angles onto a second frame section where flight bars push them transversely between two rotary cutters which cut inclined surfaces on opposite ends of each brick, after which the finished brick is pushed at right angles onto a conveyor belt mounted on a third or discharge frame section which extends parallel to the first frame section.

19 Claims, 6 Drawing Figures

BRICK FINISHING MACHINE

This invention relates to a brick finishing machine, and more particularly to a machine for shaping fire bricks of the type employed in electric kilns.

In electric kilns of the type described, a steel housing is lined with specially-shaped fire bricks having aligned grooves in which are housed the electric heater wires which generate the heat for the kiln. As shown, for example, in U.S. Pat. No. 3,350,493, these grooves must be carefully formed so that they will register properly with one another when the bricks are mounted within the kiln housing. Also, of course, the overall configurations of the bricks must be such that they will form, when joined, the desired configuration of the heating chamber.

Heretofore there has been no satisfactory apparatus for quickly and accurately shaping fire bricks of the type described. Many manual steps were required to grind and/or cut desired surface configurations on the bricks. Prior machines which have been available, have not been able accurately to produce a respective fire brick on an assembly line basis.

Accordingly, a primary object of this invention is to provide an improved brick finishing machine which is capable of accurately and rapidly forming fire bricks of the type described into their desired, ultimate configurations.

Another object of this invention is to provide an improved machine of the type described which, in one continuous operation, is capable of automatically shaping and grooving each fire brick to the desired configuration.

Still another object of this invention is to provide a new finishing machine which performs several successive grinding and cutting operations on fire bricks which are conveyed one by one through the machine.

A further object of this invention is to provide a machine for automatically grinding and cutting conventionally shaped rectangular bricks to form thereon specially shaped surfaces as well as special grooves within the bricks.

A further object of this invention also is to provide an automatic brick finishing machine capable of performing grinding operations on at least two or more surfaces of a brick simultaneously.

It is an object of the invention to provide a finishing machine which grinds and cuts various surfaces on a brick without discharging objectionable dust and/or particles in the atmosphere around the machine.

Other objects of the invention will be apparent hereinafter from the specification and from the recital of the appended claims, particularly when read in conjunction with the accompanying drawings.

Figure 6:
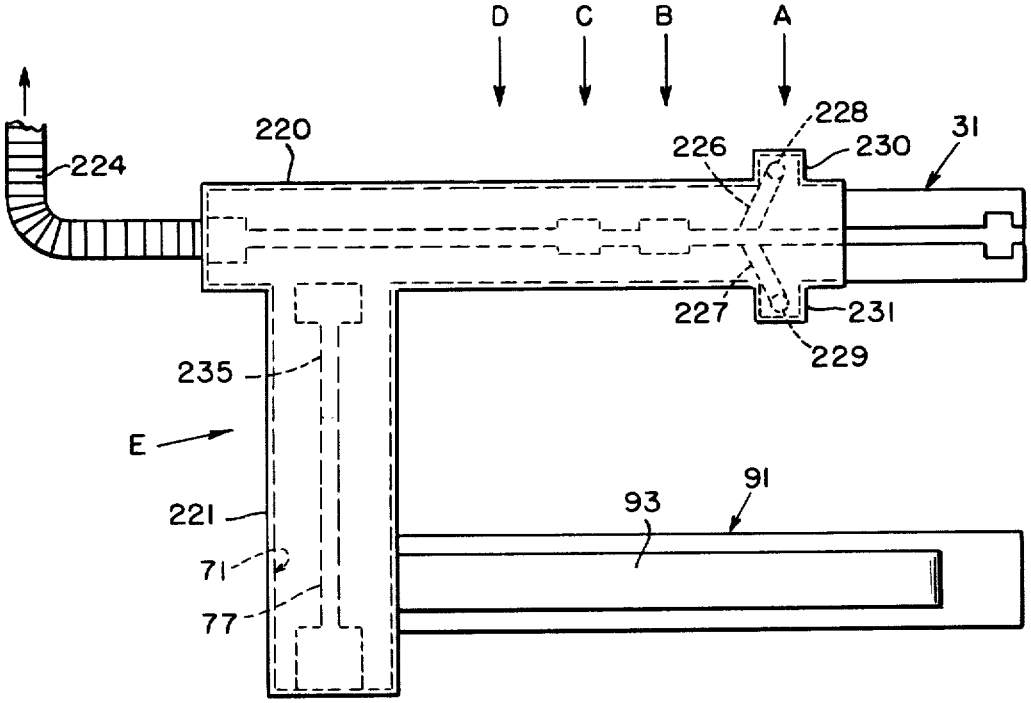
Figure 3:
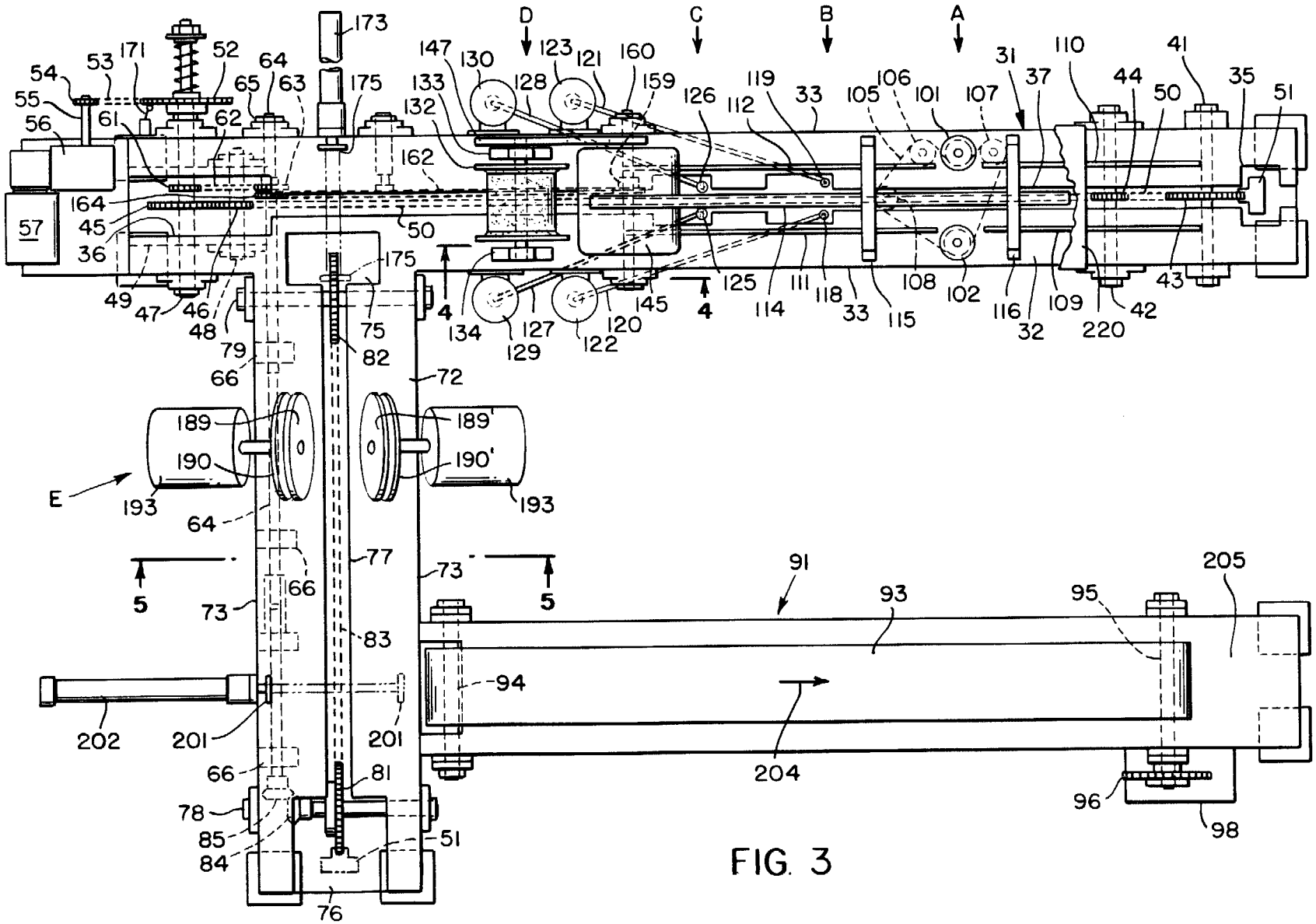
FIG. 3 is a fragmentary plan view of one embodiment of a machine for making the fire bricks shown in FIGS. 1 and 2, portions of the machine being removed for purposes of illustration.
Figure 4:
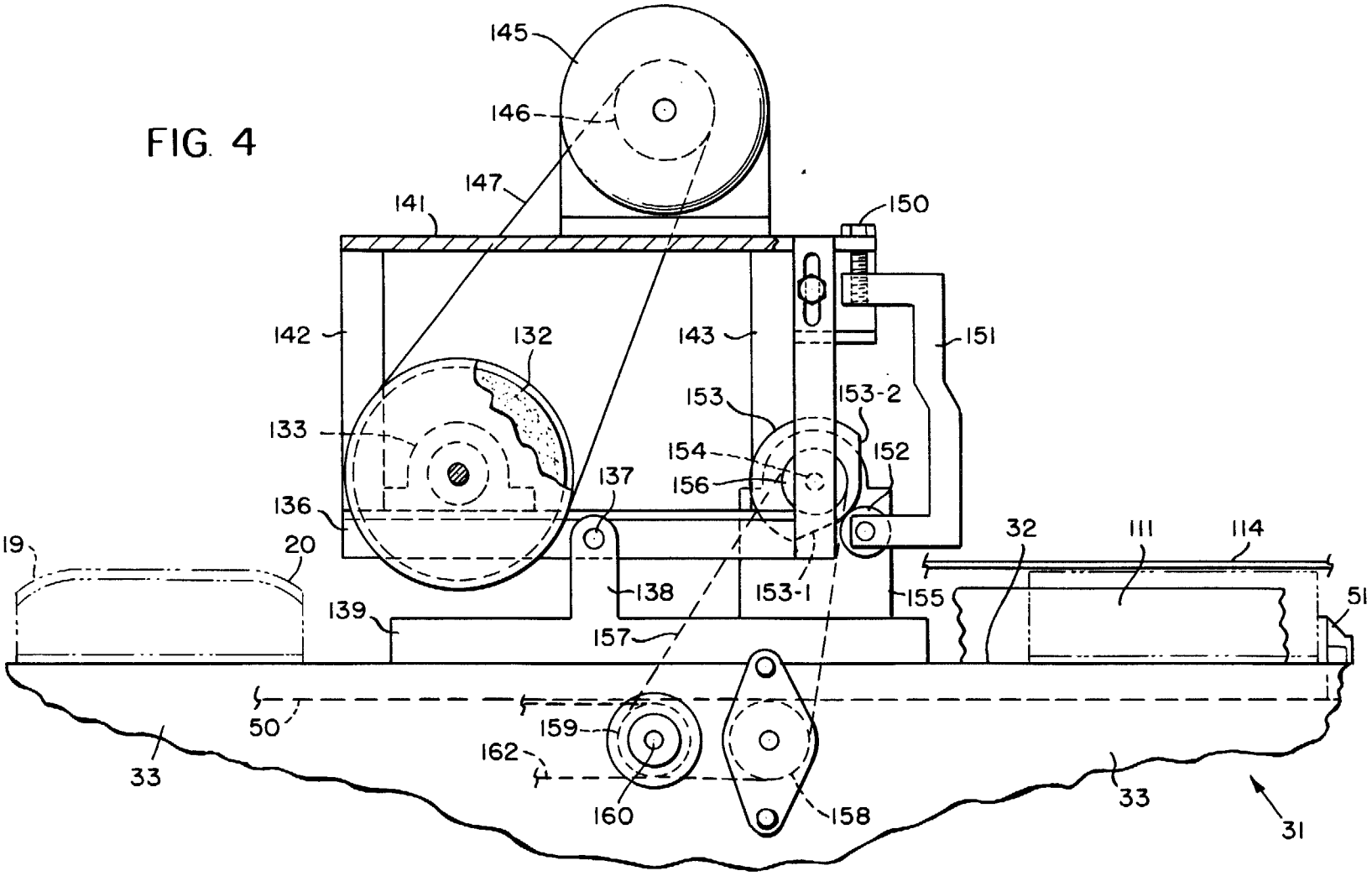
Figure 5:
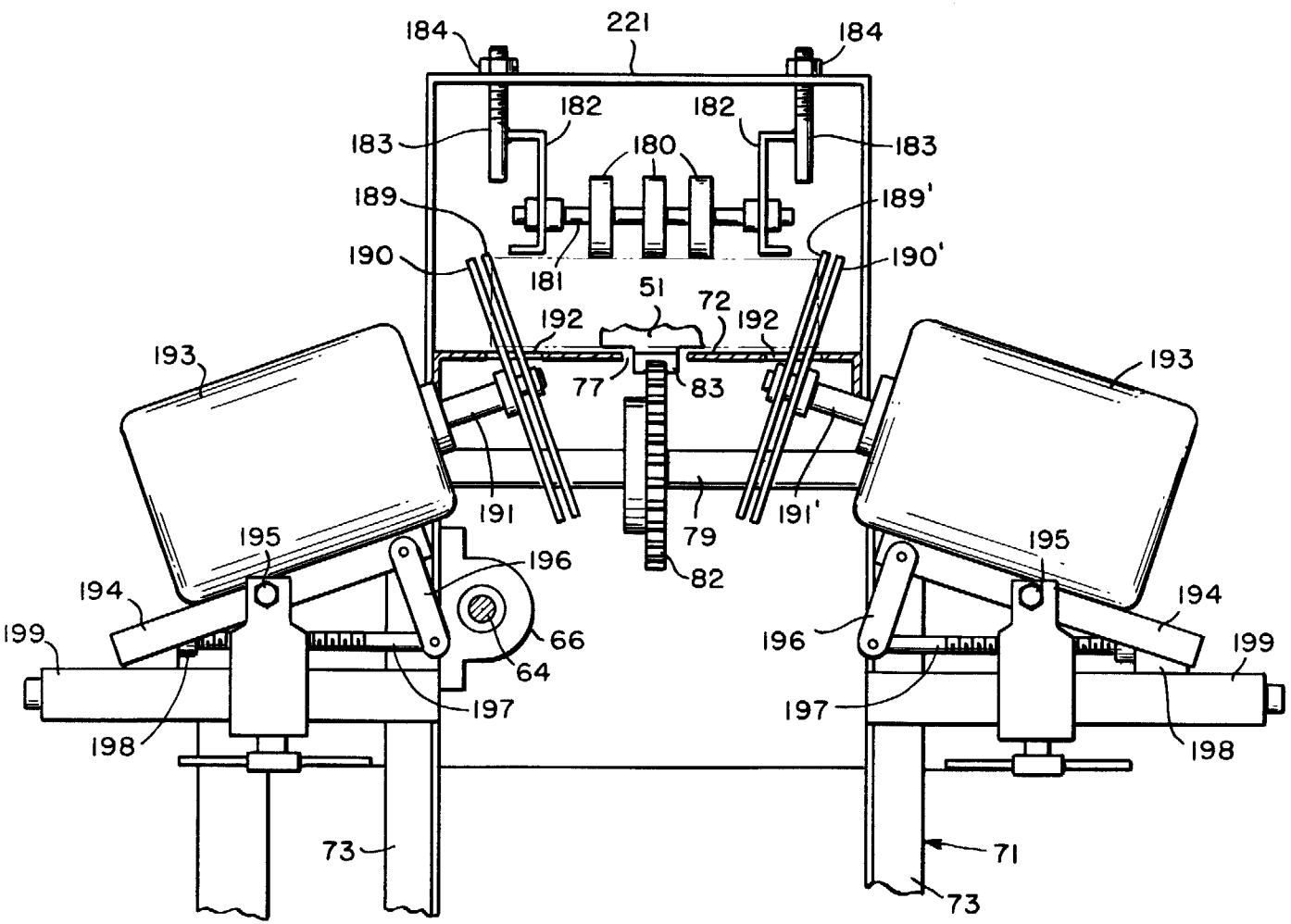

FIGS. 4 and 5 are enlarged, fragmentary sectional views taken generally along the lines 4—4 and 5—5, respectively, in FIG. 3 looking in the direction of the arrows; and FIG. 6 is a schematic plan view of this machine showing the dust housings which are used to collect dust and brick chips produced during its operation.

Figure 1:
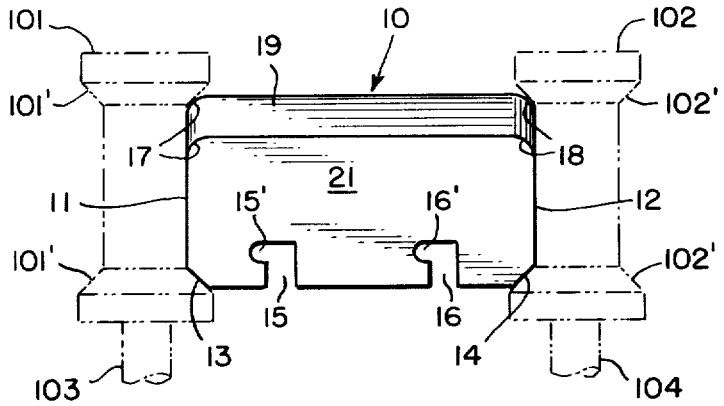
FIG. 1 is an end view of a fire brick made according to one embodiment of this invention, with parts of the machine for producing the brick being shown in phantom by broken lines.
Figure 2:
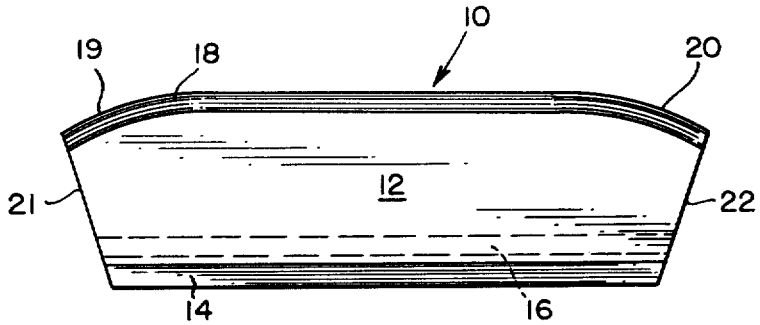
FIG. 2 is a side elevational view of this fire brick.

Referring now to the drawings by numerals of reference, and first to FIGS. 1 and 2, 10 denotes generally a finished fire brick which has been shaped by a finishing machine of the type illustrated in FIGS. 3 to 6. In its unfinished, or "as manufactured" form, the brick has the usual rectangular configuration. However, as it is fed through the finishing machine, as described hereinafter, each brick passes give successive grinding or cutting stations, which in FIG. 3 are denoted generally by the arrows A, B, C, D and E, respectively.

When a brick reaches the first grinding station A, its opposed side surfaces 11 and 12 are ground so that the desired width of the brick is attained, and at the same time its lower, longitudinal side edges are ground to form thereon the chamfered or bevelled surfaces 13 and 14. At the second station B two straight, parallel grooves 15 and 16 are cut in the bottom of the brick; and at the third station C two radius or lateral grooves 15' and 16' are cut into the side walls at one side of the grooves 15 and 16, respectively. At the fourth station D the upper, longitudinal side edges of the brick are rounded off as at 17 and 18, and opposite ends of its top are ground away to form thereon the curved or tapered surfaces 19 and 20. Finally, at the fifth station E, opposite ends of the brick are cut away to form thereon the inclined end surfaces 21 and 22.

Referring now to FIGS. 3 to 6, 31 denotes generally an upright frame or charging section comprising a horizontal top plate 32 which has downwardly depending side sections 33. A pair of rectangular openings 35 and 36, which are formed in plate 32 adjacent opposite ends thereof, are connected by an elongate slot 37 which is formed in plate 32 medially of its sides. Opening 35 is located adjacent the charging or input end of frame section 31 (right hand end as shown in FIG. 3), while opening 36 is located adjacent the opposite or discharge end of frame 31 (its left hand end as shown in FIG. 3).

Mounted on a pair of spaced, parallel idler shafts 41 and 42, which extend transversely between the sides of frame 31 adjacent its inlet end, are two sprocket wheels 43 and 44, respectively. Wheels 43 and 44 rotate in a common vertical plane, and in registry with slot 37. The larger wheel 43, which is offset above the smaller wheel 44, is positioned so that its teeth rotate substantially tangentically of the underside of the plate 32, and immediately adjacent the opening 35. Two further sprocket wheels 45 and 46 are mounted on shafts 47 and 48, respectively, adjacent the opposite or discharge end of frame 31, and rotate in the same vertical plane as wheels 43 and 44. Wheel 46 and its shaft 48 are supported for rotation beneath plate 32 by a bracket 49, which projects downwardly from the underside of plate 32 intermediate its side sections.

The four sprocket wheels 43, 44, 45 and 46 drive an endless roller chain 50 (broken lines in FIGS. 3 and 4), the lower run of which passes beneath the sprocket wheels 44 and 46, and the upper run of which travels over the sprocket wheels 43 and 45, and just beneath plate 32 centrally of its slot 37. Chain 50 carries a plurality of spaced flight bars or pusher plates 51, one of which is shown in FIG. 3 as it passes through opening 35, as noted hereinafter.

The supporting shaft 47 for the sprocket wheel 45 projects at one end (its upper end in FIG. 3) beyond one side of the frame 31, and has mounted thereon a sprocket wheel 52, which is connected by a chain 53 to a drive sprocket 54. Sprocket 54 is fastened to the drive shaft 55 of a speed reduction unit 56 that is driven by an electric motor 57.

Also secured to shaft 47 to be driven thereby is a further drive sprocket 61 (FIG. 3), which is connected by a chain 62 to another sprocket wheel 63 that is fastened to an elongate drive shaft 64, which is mounted beneath and parallel to the shaft 47. Shaft 64 is rotatably journaled at one end in a bearing 65, which is mounted on one side of frame 31 (the upper side as shown in FIG. 3), and intermediate its ends extends rotatably through a plurality of spaced bearings 66, which are mounted on one side 73 of another frame 71, which projects at right angles (downwardly in FIG. 3) from the side of frame 31 adjacent its discharge end.

The frame or stand 71 has a horizontal top plate 72, which is coplanar with plate 32 of frame 31. Medially of its side edges plate 72 has therein an elongate slot 77, which opens at one end (its upper end in FIG. 3) on a rectangular opening 75 that is formed in plate 32 of frame 31 at one side of its discharge end, and at its opposite end opens on another rectangular opening 76 formed in the plate 72 adjacent its lower or discharge end as shown in FIG. 3.

Mounted for rotation beneath plate 72 adjacent opposite ends of the slot 77, and extending transversely between the sides 73 of frame section 71, are two parallel shafts 78 and 79. Sprocket wheels 81 and 82, which are mounted on shafts 78 and 79, respectively, are drivingly connected to each other by an endless roller chain 83, which in FIG. 3 is denoted by broken lines. Shaft 78 has fixed thereon a miter gear 84, the teeth of which are drivingly engaged with a mating gear 85, which is fastened to the end of shaft 64 remote from its bearing mounting 65, so that any rotation imparted to shaft 64 by the drive sprocket 61 and chain 62, will be transmitted through the gears 84 and 85 to shaft 78. This motion is, in turn, imparted through the chain 83 to the sprocket wheel 82, so that chain 83 can be driven in unison with the chain 50.

A third frame, or discharge stand 91, projects at right angles from one side of the frame section 71 adjacent its discharge or lower end as shown in FIG. 3. Frame 91 is disposed in spaced, parallel relation to the charging frame 31, and has mounted thereon an endless conveyor belt 93, the upper run of which is disposed coplanar with the upper surface of the frame plate 72. Belt 93 travels around spaced, parallel shafts 94 and 95, which are mounted to extend transversely between opposite sides of frame 91 adjacent opposite ends thereof. Shaft 95 has on one end thereof a sprocket wheel 96, which is connected in any conventional manner with the output shaft of, for example, a motor-driven, speed reducing unit 98, which is mounted beneath the upper surface of frame 91.

For conveying bricks longitudinally of the charging section 31, the flight bars 51 project radially outwardly from the associated chain 50, so that when the upper run of the chain is being driven from the right to the left in FIG. 3, the bars 51 pass endlessly and succesively upwardly through the opening 35 in the frame section 32, and then travel horizontally across the upper surface of the slot 37, finally passing downwardly through the opening 36 at the opposite end of section 31. Similar pusher plates 51 are mounted on chain 83, and as noted hereinafter, are disposed to be carried by that chain upwardly through the opening 75 at the inlet end of frame 71, then horizontally across the upper surface of plate 72 above slot 77, and then downwardly through the opening 76 at the opposite end of section 71.

Referring again to FIG. 3, a pair of spaced grinding drums 101 and 102 are mounted at station A to rotate about vertical axes just above the upper surface of frame plate 32, and adjacent opposite sides of the slot 37. These drums, which are also shown in phantom by broken lines in FIG. 1, have operating shafts 103 and 104 which project downwardly through the plate 32 and have thereon pulleys (not illustrated) drivingly connected by a twosided timing belt 105 to a pair of idler pulleys 106 and 107, and to a driving pulley 108 (FIG. 3), which is connected to the output shaft of, for example, a fractional horsepower electric motor (not illustrated). When the machine is operating, the driving pulley 108 inparts rotation through the belt 105 to the two upright grinding drums 101 and 102, the peripheral surfaces of which are spaced apart a distance approximately equal to the desired width of the finished fire brick. Moreover, as shown in FIG. 1, each of the grinding drums 101 and 102 has thereon a pair of axially spaced, truncated-conical grinding surfaces 101′ and 102′, respectively. As will be noted from FIG. 1, during the passage of a brick 10 between the rotating drums 101 and 102, the lower pair of inclined surfaces 101′ and 102′ form correspondingly inclined or bevelled surfaces 13 and 14 along the lower side edges of the brick. The upper edges of the brick are also bevelled at this station, but rounded off, so that they are not apparent on the finished brick 10 as illustrated in FIG. 1.

After a brick has passed between the grinding drums 101 and 102, it passes over a pair of laterally spaced vertically disposed carbide midget mills or groove cutters 118 and 119, which are mounted at station B on frame 31, and beneath plate 32, for rotation about spaced, vertical axes. These cutters project at their upper ends slightly above the upper surface of plate 32, and into the path of an advancing brick, so that as the brick passes over the cutters 118 and 119 they grind or cut in the underside of the brick the spaced, parallel grooves denoted at 15 and 16 in FIG. 1. Beneath the table section or plate 32, the operating shafts of the cutters 118 and 119 have thereon pulleys (not illustrated), which are connected by flexible steel cables 120 and 121 to the drive shafts of a pair of electrical motors 122 and 123, respectively, which are supported on brackets at opposite sides, respectively, of the frame 31. These motors are of the flexible shaft variety, and may be of the type sold, for example, under the trademark Dumore Flex motor.

To the left of the cutters 118 and 119 as shown in FIG. 3, and at the station indicated by the arrow C, two additional groove cutters 125 and 126 are mounted to rotate about vertical axes located adjacent opposite sides of the slot 37. As in the case of the cutters 118 and 119, the cutters 125 and 126 project slightly above the upper surface of the frame plate 32, and are positioned to enter the slots 15 and 16 previously formed in the advancing brick, and to grind in one side of each of the slots (the left hand sides as shown in FIG. 1) a radius groove 15′ and 16′, respectively. By way of example, the cutters which perform this operation may be special carbide mills having a convex radius, and being ⅜″ in diameter and 5/16″ thick. The cutters 125 and 126 project beneath the underside of plate 32 and have thereon pulleys (not illustrated) drivingly connected by flexible steel cables 127 and 128, respectively, with a pair of motors 129 and 130, which are similar to the motors 122 and 123, and which also are mounted on opposite sides, respectively, of frame 31.

In order to guide an incoming brick into the space between the grinding drums 101 and 102, and over the tops of the cutters 118, 119, 125 and 126, two pairs of spaced, parallel guide plates 109, 110, and 111, 112 (FIG. 3) are fastened to the upper surface of the frame plate 32 adjacent opposite sides of slot 37. The first pair of guide plates 109 and 110 extend from the inlet end of frame 31 adjacent the opening 35 to points immediately preceding the grinding drums 101 and 102. The second pair of guide plates 111 and 112 extend from points adjacent the discharge sides of the drums 101 and 102 to points adjacent the fourth grinding station D, which will be described in more detail hereinafter. Also, to hold the advancing bricks resiliently against the surface of plate 32 during movement of the bricks past stations A, B, C, a horizontally disposed upper guide plate 114 (FIG. 3) is supported by a pair of spaced brackets 115 and 116 above the frame plate 32, and in registry with the slot 37. Plate 114 slidably engages the upper surfaces of bricks as they are fed along plate 32, and thereby prevents the bricks from being forced upwardly during a grinding operation. Opposite ends of the plate 114 are curved slightly upwardly to enable an incoming brick to pass slidably beneath its right end as illustrated in FIG. 3, and to enable discharge of the brick into the fourth grinding station D, as noted hereinafter.

Following the grooving operations each brick passes to the left in FIG. 3 beyond guide plates 111, 112 and 114, and beneath a grinding drum 132 (FIG. 3), which is mounted above plate 32 at the fourth station D for rotation about a horizontal axis that extends transverse to frame 31. The shaft of drum 132 is rotatably journaled at opposite ends in pillow blocks 133 and 134 that are carried by a pair of laterally spaced frame members 136, one of which is shown in FIG. 4. Each member 136 pivots intermediate its ends about a horizontally disposed pin 137, which is carried by the leg 138 of a bracket 139 that is mounted on each side of frame 31. A motor support plate 141 is secured on the upper ends of a pair of vertical legs 142 and 143, which project upwardly from opposite ends of each frame member 136. A fractional horsepower motor 145, which is mounted on plate 141, has on its drive shaft a pulley 146 which is connected by a belt 147 to a drive pulley that is secured to one end of the shaft which supports drum 132, so that upon operation of motor 145 the drum 132 is rotated about its horizontal axis.

At the rear or right hand edge of plate 141, as shown in FIG. 4, a cam follower arm 151 is adjustably connected at its upper end by a bolt 150 to plate 141; and on its lower end arm 151 carries a rotatable cam follower or roller 152, which is in rolling engagement with the peripheral surface of a cam 153. This cam is secured to a shaft 154, which projects from a pillow block 155 at one side of the frame 31, and which carries a sprocket wheel 156 that is connected by chain 157 to an idler sprocket 158, and to a drive sprocket 159 that is mounted beneath plate 32 on a shaft 160 (FIGS. 3 and 4) that extends transversely between opposite sides of frame 31. Sprocket wheel 159 is connected by a roller chain 162 (broken lines in FIGS. 3 and 4) to a wheel 164 (FIG. 3) that is fixed to shaft 64 adjacent the sprocket wheel 63.

Cam 153 is thus rotated in unison with the advance of the main charging chain 50; and assuming that it rotates counter-clockwise from its position as shown in FIG. 4 approximately at the moment that the leading edge of a brick engages the rotating drum 132, then for approximately the first 90° of rotation of the cam, its surface 153-1 (FIG. 4) will cause the frame members 136 to be pivoted slowly in a clockwise direction about the axis of pin 137, thereby gradually elevating the rotating drum 132 so that it grinds on the leading edge of the brick the curved surface denoted at 19 in FIG. 4. Thereafter for approximately 180° of rotation of cam 153 the drum 132 will be held in its slightly elevated position, thereby causing the upper surface of the brick to be ground with a plane, flat surface. As the cam 153 completes approximately the last quarter of its rotation the lull portion 153-2 of the cam will rotate beneath the follower 152, thereby causing drum 132 to be swung counter-clockwise about the axis of pin 137, or toward its lowered position, thereby grinding the curved surface 20 on the trailing end of the brick as shown in FIG. 4.

As shown more clearly in FIG. 3, drum 132 has flanged ends, which are connected to the principal grinding surface of the drum by curved, trucated-concave surfaces of particularly small radius. It is these curved surfaces which grind the small curved surfaces 17 and 18 along the upper, longitudinal side edges of the brick as it passes beneath drum 132.

Each time the driving sprocket 52 rotates a predetermined amount, a detent thereon engages and trips a limit switch 171, (FIG. 3) which is mounted on the side of frame 31 adjacent wheel 52. Each time switch 171 is tripped a signal is applied to a conventional valve (not illustrated), which controls the flow of compressed air to a cylinder 173, which is mounted at one side of frame 31 (the upper side of FIG. 3) adjacent its discharge end. A piston rod, which reciprocates in cylinder 173 parallel to the slot 77 in the frame section 71, carries on its outer end a pusher plate 175 which reciprocates between a retracted position (solid lines in FIG. 3), in which it is located rearwardly of the path followed by the advancing bricks on frame 31, and an advanced position (broken lines in FIG. 3) in which it overlies the opening 75 in frame section 71. The reciprocation of plate 175 is synchronized with the movement of the chain 50, so that each time a brick passes beneath the drum 132 and moves into registry with the retracted plate 175, the cylinder 173 is operated to advance the pusher plate at right angles to the travel of the brick, (downwardly in FIG. 3), whereby the plate engages and pushes brick onto the inlet end of frame section 71. The pusher plate 175 is immediately retracted, but leaves the brick in position to be engaged by one of the flight bars 51 on chain 83 as the bars advance upwardly through the opening 75.

As bricks are advanced on frame 71 by the chain 83 they pass beneath a plurality of spaced, rubber wheels 180 (FIG. 5), which are mounted to rotate about the axis of a horizontal shaft 181, which extends transversely above the plate 72 intermediate its ends. Opposite ends of shaft 181 are rotatably journaled in a pair of spaced brackets 182, which project downwardly from a pair of vertically adjustable pins 183 that are secured by nuts 184 to the top of a dust housing 221 which overlies frame 71. Housing 221, which will be described in greater detail hereinafter, supports the rollers 180 for rolling engagement with the upper surfaces of the bricks as they pass between two pairs of laterally spaced, circular saw blades 189, 190 and 189', 190', which project upwardly through a pair of laterally spaced slots 192 that are formed in frame plate 72 adjacent opposite sides of slot 77. The two pairs of blades are secured, respectively, to the upper ends of a pair of spaced drive shafts 191, 191', which rotate beneath plate 72 about inclined axes; and which support to two pairs of blades for rotation in planes that are inclined to the horizontal by predetermined equal amounts that correspond to the desired inclination of the end surfaces 21 and 22 on each brick 10. Consequently, as a brick is advanced between the rotating pairs of blades 189, 190 and 189', #' opposite ends of the brick are cut away to form thereon inclined end surfaces 21 and 22 (FIG. 2). The inner blades 189, 189' cut the desired angular surfaces 21 and 22 on each brick, and the outer blades 190 and 190' of the two pairs, which have deeper sets, chop up the scrap pieces of brick.

The operating shafts 191 and 191' for the abovedescribed saw blades project from a pair of similar electric motors 193, which are mounted on a pair of like supports plates 194 that are located adjacent opposite sides, respectively, of the frame 71. Each plate 194 is mounted intermediate its ends to pivot about the horizontal axis of a pin or bolt 195, and is pivotally connected at its inner end to the upper end of a link 196, the lower end of which is pivotally connected to the inner end of an adjusting screw 197. Each screw 197 has its outer end threaded into a rotatable adjusting nut, which is supported on a block 198 carried by a carriage support plate 199 that projects horizontally from each side of frame 71. When the adjusting arm associated with each screw 197 is rotated, the screw will shift horizontally either toward or away from the side of frame 71, thus elevating or lowering the associated motor 193, as desired, thereby to place the corresponding cutting blades 189, 190 or 189', 190', in the desired, inclined planes.

After the inclined surfaces 21 and 22 have been cut on opposite ends of the brick, the brick passes along frame 71 into registry with the retraction pusher plate 201 (FIG. 3), which is fastened to the outer end of a piston rod which reciprocates in a further air cylinder 202, which is generally similar to cylinder 173, and which is mounted at one side of frame 71 (the left side as shown in FIG. 3) adjacent the discharge end thereof. As in the case of cylinder 173, the operation of cylinder 202 is synchronized with the movement of the chain 83 on frame 71, so that when a finished brick passes in front of the retracted head 201 (solid lines in FIG. 3), cylinder 202 is actuated to cause the head 201 to be advanced into its broken line position as shown in FIG. 3. This causes the associated brick to be transferred off of frame 71 onto the surface of the endless conveyor belt 93, which travels in the direction indicated by the arrow 204 in FIG. 3. Belt 93 conveys the finished bricks toward an unloading or discharge surface 205, which is formed on frame 91 at the right hand end thereof as shown in FIG. 3.

To collect the dust and brick chips produced at the various cutting or grinding stations A-D, an elongate dust housing or cowling 220, which is generally inverted U-shaped is cross section, is mounted on frame 31 to overlie its upper surface from a point located between station A and the input end of frame 31 (FIGS. 3 and 6), to a point adjacent the extreme left hand end of frame 31 as shown in FIG. 6. A further, similarly-shaped dust housing 221 overlies frame 71, and as shown in FIG. 6, has one end which opens on the side of housing 220 at the point where bricks are transferred from frame 31 to frame 71. A further opening (not illustrated) is formed in the side (right side as shown in FIG. 6) of housing 221 at the discharge end of frame 71 to allow bricks to be transferred off of frame 71 onto the belt 93.

Extending longitudinally beneath frame 31 is an exhaust plenum or duct 224 (FIG. 6), which is connected at one end to a conventional suction or vacuum source referred in the drawing as the dust collector. Plenum 224 is connected adjacent its opposite by a pair of branch ducts 226 and 227 to registering openings 228 and 229, respectively, which are formed in the bottoms of extensions 230 and 231 that are formed on opposite sides of housing 220 to cover the grinding drums 101 and 102 at station A. The duct 224 also opens as at 233 and 234 on the bottom of housing 220 at stations B and C to convey awawy dust generated at these stations, and on opening 36 in plate 32 to collect any dust reaching the discharge end of frame 31.

Dust from station E is collected by another branch duct which is located beneath frame 71 with one end connected to plenum 224, and its opposite end communicating with an opening 236 formed in the bottom of housing 221 beneath the cutters 189, 190, 189' and 190'.

From the foregoing, it will be apparent that the instant invention provides extremely clean and efficient means for mass producing finished bricks of the type particularly suited for use in electric kilns. From the time that a brick is placed on frame 31 at its inlet end, all of the grinding and cutting operations are performed automatically and require no manual operations. A simple rectangular brick is therefore transformed into the specially configured brick 10 as shown in FIGS. 1 and 2. The advantage of the machine is that it virtually eliminates a number of manual operations which heretofore were necessary in order to produce kiln bricks. Moreover, by performing all operations within a protective dust housing, undesirable discharge of chips or powder from the bricks is eliminated, thus reducing the possibility of human injury to those working on or near the machine. Also, since its is a relatively simple matter to mount the grinding ends or cutting devices for limited adjustment, it is possible to produce on this machine finished fire bricks which, although generally similar in configuration, are slightly different in their overall size.

Moreover, while this invention has been illustrated and described in detail in connection with only one embodiment thereof, it will be apparent that it is capable of still further modifications, and that this application is intended to cover any such modifications as may fall within the scope of one skilled in the art or the appended claims.

Having thus described my invention, what I claim is:

1. A brick finishing machine for cutting and grinding rectangularly shaped bricks into specially configured bricks, comprising a first frame, first drive means for conveying bricks in single file along a horizontal surface on said first frame from an inlet station adjacent one end of said frame to a discharge station adjacent the opposite end thereof.

a second frame having an inlet end connected to one side of said first frame adjacent said discharge station, and extending transverse to the path of travel of a brick on said first frame, grinding means on said first frame for performing a series of grinding operations on different poritions of each brick as it passes from said inlet to said discharge station, first transfer means operative each time a brick reaches said discharge station on said first frame to effect transfer thereof onto the inlet end of said second frame, second drive means for conveying bricks that are transferred from said first to said second frame in single file along a horizontal surface on said second frame from said inlet end thereof toward the opposite end of said second frame, and means on said second frame for performing at least one cutting operation on each brick as it passes from said inlet to said opposite end of said second frame.

2. A brick finishing machine as defined in claim 1, including second transfer means on said second frame adjacent said opposite end thereof and operative, each time a brick approaches said opposite end, to move the last-named brick off said second frame, and in a direction transverse to path of travel of the brick from said one to said opposite end of said second frame.

3. A brick finishing machine as defined in claim 1, wherein said grinding means comprises a first pair of grinding drums mounted on said first frame for rotation about spaced, vertical axes, and having thereon cylindrical grinding surfaces tangentially engageable with opposite sides of each brick conveyed along said first frame to grind each brick to its desired width.

4. A brick finishing machine as defined in claim 3, wherein each of said first pair of grinding drums has thereon, adjacent at least one end of its cylindrical grinding surface, a truncated-conical grinding surface, engageable with the lower side edge of a brick to grind a bevelled edge thereon.

5. A brick finishing machine as defined in claim 3, wherein said grinding means further includes means for grinding a pair of parallel grooves in the underside of each brick during passage from said inlet to the discharge station on said first frame, and a third drum mounted to rotate about a horizontal axis above said horizontal surface on said first frame and having thereon a cylindrical grinding surface tangentially engageable with the upper surfaces of the bricks conveyed along said first frame.

6. A brick finishing machine as defined in claim 5, wherein said means for grinding a pair of parallel grooves in said bricks comprises a first pair of spaced grinding wheels projecting slightly above said horizontal surface on said first frame to engage and grind a first pair of slots into the underside of each brick, and a second pair of spaced grinding wheels spaced beyond said first pair of wheels in the direction of travel of said bricks on said first frame, and projecting above said horizontal surface to extend into said first pair of slots formed in each brick, and to grind lateral slots in one side only of each of said first pair of slots thereby to complete said pair of grooves in the underside of each brick.

7. A brick finishing machine as defined in claim 5, including means mounting said third drum for limited pivotal movement about a stationary axis extending parallel to the axis of rotation of said third drum, and cam means connected to said first drive means and operable thereby intermittently to pivot said third drum between upper and lower limit positions, respectively, while said third drum is rotating.

8. A brick finishing machine as defined in claim 7, wherein said cam means includes a rotary cam having on its periphery an operating surface which is effective successively to lower said third drum into the path of an advancing brick, slowly to elevate the third drum to cause a curved surface to be ground on the leading end of the brick, to retain the third drum in an elevated position until the trailing end of the brick passes therebeneath, and then slowly to lower the third drum to cause a curved surface to be ground on the trailing end of the brick.

9. A brick finishing machine as defined in claim 8, wherein said third drum has thereon a pair of axially-spaced, truncated-concave grinding surfaces engageable with the upper, longitudinal side edges of each brick passing beneath the third drum thereby to round off said upper side edges.

10. A brick finishing machine as defined in claim 3, including spaced guide members on said horizontal surface of said first frame and extending longitudinally thereon to guide incoming bricks into the space between said first pair of grinding drums, and a further guide member mounted on said first frame to overlie the space between said spaced guide members, and slidingly to engage the upper surface of each brick conveyed along said first frame.

11. A brick finishing machine as defined in claim 1, wherein said means on said second frame comprises a pair of spaced, rotary cutters mounted on said second frame adjacent opposite sides thereof, and positioned to engage opposite ends, respectively, of each brick conveyed along said second frame, and means mounting said cutters for rotation in planes inclined to the horizontal and to each other, whereby opposite ends of each brick are cut away to form inclined end surfaces thereon.

12. A brick finishing machine as defined in claim 1, including a dust housing mounted on each of said frames substantially to surround each portion of a frame on which a grinding or cutting operation takes place, and means for connecting the interior of each dust housing with a vacuum source to convey away dust and particles created in the housing as a result of the grinding or cutting operation taking place therein.

13. A brick finishing machine as defined in claim 1, wherein said first drive means comprises a first endless chain mounted beneath said horizontal surface on said first frame, and with the upper run of said chain disposed to register with an elongate slot formed centrally in said horizontal surface to extend between said inlet and discharge stations, respectively, a plurality of spaced pusher plates secured to said first chain and disposed to be conveyed thereby in single file on said horizontal frame surface transversely of said elongate slot, and in a direction from the inlet toward the discharge station on said first frame, and an electric motor operatively connected to said first chain to impart motion thereto.

14. A brick finishing machine as defined in claim 13, wherein said second drive means comprises a second endless chain mounted beneath an elongate slot in said second frame, and having thereon spaced pusher plates for conveying bricks along said horizontal surface on said second frame, and means connecting said second chain to said electric motor for operation thereby simultaneously with the operation of said first chain.

15. A brick finishing machine as defined in claim 2, including a third frame having an inlet end connected to one side of said second frame adjacent said opposite end thereof, and in registry with said second transfer means thereby to receive bricks dishharged from the second frame by the second transfer means, and means on said third frame engageable with bricks discharged onto said third frame to convey the last-named bricks from said inlet end of the third frame toward the opposite end thereof, and parallel to said first frame.

16. A machine for finishing bricks, comprising frame means having thereon a plurality of spaced operating stations at each of which a grinding or cutting operation is performed on a brick, means for conveying bricks one by one on said frame means successively past each of said spaced operating stations, means at one of said stations for simultaneously grinding opposite sides of each brick, means at another of said stations for grinding at least one slot in the underside of each brick, means at a third one of said stations for grinding off portions of the upper surface of each brick adjacent opposite ends thereof to form curved surfaces on the upper ends of each brick, and means at a fourth one of said stations for cutting off similar portions of each brick at each end thereof, and along planes inclined to the underside of each brick.

17. A machine for finishing bricks as defined in claim 16, including means at a fifth one of said stations for grinding a groove in one sidewall of each slot formed in the underside of each brick, said groove being formed adjacent the inner end of the associated slot in a brick, and extending the entire length of the brick.

18. A machine for finishing bricks as defined in claim 17, including guide means at each of said stations for holding a brick against undesireable movements in horizontal and vertical directions while a grinding or cutting operation is being performed thereon.

19. A machine for finishing bricks as defined in claim 16, including vacuum means at each station connected to a dust collector and operative to convey away to said collector dust and dirt generated by the cutting or grinding operations at said stations.

* * * * *